US007467977B1

(12) United States Patent
Yi et al.

(10) Patent No.: US 7,467,977 B1
(45) Date of Patent: Dec. 23, 2008

(54) ELECTRICAL CONNECTOR WITH ADDITIONAL MATING PORT

(75) Inventors: Chong Yi, Mechanicsburg, PA (US); Kuan-Yu Chen, Harrisburg, PA (US); Pei Tsao, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/151,686

(22) Filed: May 8, 2008

(51) Int. Cl.
*H01R 13/648* (2006.01)

(52) U.S. Cl. ..... 439/607; 439/541.5; 439/660; 439/680

(58) Field of Classification Search ..... 439/660, 439/607, 541.5, 680
See application file for complete search history.

(56) References Cited

U.S. PATENT DOCUMENTS

| | | | | |
|---|---|---|---|---|
| 3,986,766 | A * | 10/1976 | Sochor | 439/660 |
| 5,667,393 | A * | 9/1997 | Grabbe et al. | 600/443 |
| 6,062,892 | A * | 5/2000 | Meng et al. | 439/357 |
| 6,334,793 | B1 | 1/2002 | Amoni et al. | |
| 7,354,282 | B2 * | 4/2008 | Margulis et al. | 439/79 |
| 2006/0014431 | A1 * | 1/2006 | Shuey et al. | 439/607 |
| 2007/0049115 | A1 | 3/2007 | Igarashi et al. | |

* cited by examiner

*Primary Examiner*—Tho D Ta
(74) *Attorney, Agent, or Firm*—Wei Te Chung

(57) ABSTRACT

An electrical connector includes an electrical receptacle and an electrical plug for mating with the electrical receptacle. The electrical receptacle includes a first port, a second port communicating with the first port. The second port can accommodate a standard B-type USB 2.0 plug. The first and the second ports can be combined to receive the electrical plug for high-speed signal transmission.

12 Claims, 15 Drawing Sheets

ELECTRICAL CONNECTOR WITH ADDITIONAL MATING PORT

BACKGROUND OF THE INVENTION

1. Field of the Invention

The present invention relates to electrical connectors, more particularly to electrical connectors with additional mating ports for mating with corresponding connectors.

2. Description of Related Art

Personal computers (PC) are used in a variety of ways for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s); (Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed); 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient.

FIGS. 12 to 15 show existing USB 2.0 connectors. In FIGS. 12 to 14, this USB connector is a standard B-type USB 2.0 receptacle 300. The USB 2.0 receptacle 300 commonly is an integral part of a host or PC. The USB 2.0 receptacle 300 includes a plug-receiving cavity 31, a receptacle tongue plate portion 32 extending into the cavity 31, a plurality of contacts 33 supported by the receptacle tongue plate portion 32, and a metal shield 34 shielding the cavity 31. The tongue plate portion 32 defines a plurality of passageways (not labeled) for receiving the contacts 33. The contacts 33 are located at opposite sides of the tongue plate portion 32. Each contact 33 includes a convex shaped contact section 331 protruding into the cavity 31 for mating with corresponding plug. The USB 2.0 receptacle 300 further has a pair of beveled portions 35, 36 respectively formed on the upper left corner and the upper right corner of the cavity 31 as best shown in FIG. 13.

FIG. 15 shows a standard B-type USB 2.0 plug 400 for mating with the standard USB 2.0 receptacle 300. The USB 2.0 plug 400 includes a plug insulator 41 defining an opening 42, a plurality of contacts 43 retained in the plug insulator 41, and a metal shell 44 enclosing the plug insulator 41. The plug insulator 41 includes an upper wall 411 and a lower wall 412 with the opening 42 formed therebetween. The contacts 43 are plate-shaped and non-elastic in order to be retained on inner surfaces of the upper and lower walls 411, 412, respectively. The USB 2.0 plug 400 further includes a pair of slant portions 45, 46 located on top lateral sides thereof for mating with the corresponding beveled portions 35, 36 of the USB 2.0 receptacle 300 in order to guide correct insertion of the USB 2.0 plug 400.

As discussed above, with limited data transmission speed of the USB 2.0 connectors, there is a need to design electrical connectors with additional mating ports for high-speed signal transmission.

BRIEF SUMMARY OF THE INVENTION

An electrical connector includes an electrical receptacle and an electrical plug for mating with the electrical receptacle. The electrical receptacle includes a first receiving cavity, a second receiving cavity communicating with the first receiving cavity, a first tongue portion extending into the first receiving cavity and a second tongue portion extending into the second receiving cavity. A plurality of first contacts are disposed on a mounting surface of the first tongue portion. A plurality of second contacts are disposed on opposite first and second surfaces of the second tongue portion and protrude into the second receiving cavity. The first receiving cavity is essentially narrower than the second receiving cavity. The first and the second tongue portions are parallel to each other.

An electrical plug includes a first opening, a second opening and a metal shield shielding the first and the second openings. A plurality of first plug contacts protrude into the first opening. A plurality of second plug contacts are exposed to the second opening. The first and the second openings are separated by a separate plate in condition that the first and the second plug contacts are disposed on opposite first and second sides of the separate plate, respectively.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Within the following description, a standard USB 2.0 connector, receptacle, plug, and signaling all refer to the USB architecture described within the Universal Serial Bus Specification, 2.0 Final Draft Revision, Copyright December, 2002, which is hereby incorporated by reference herein.

Figure 10:
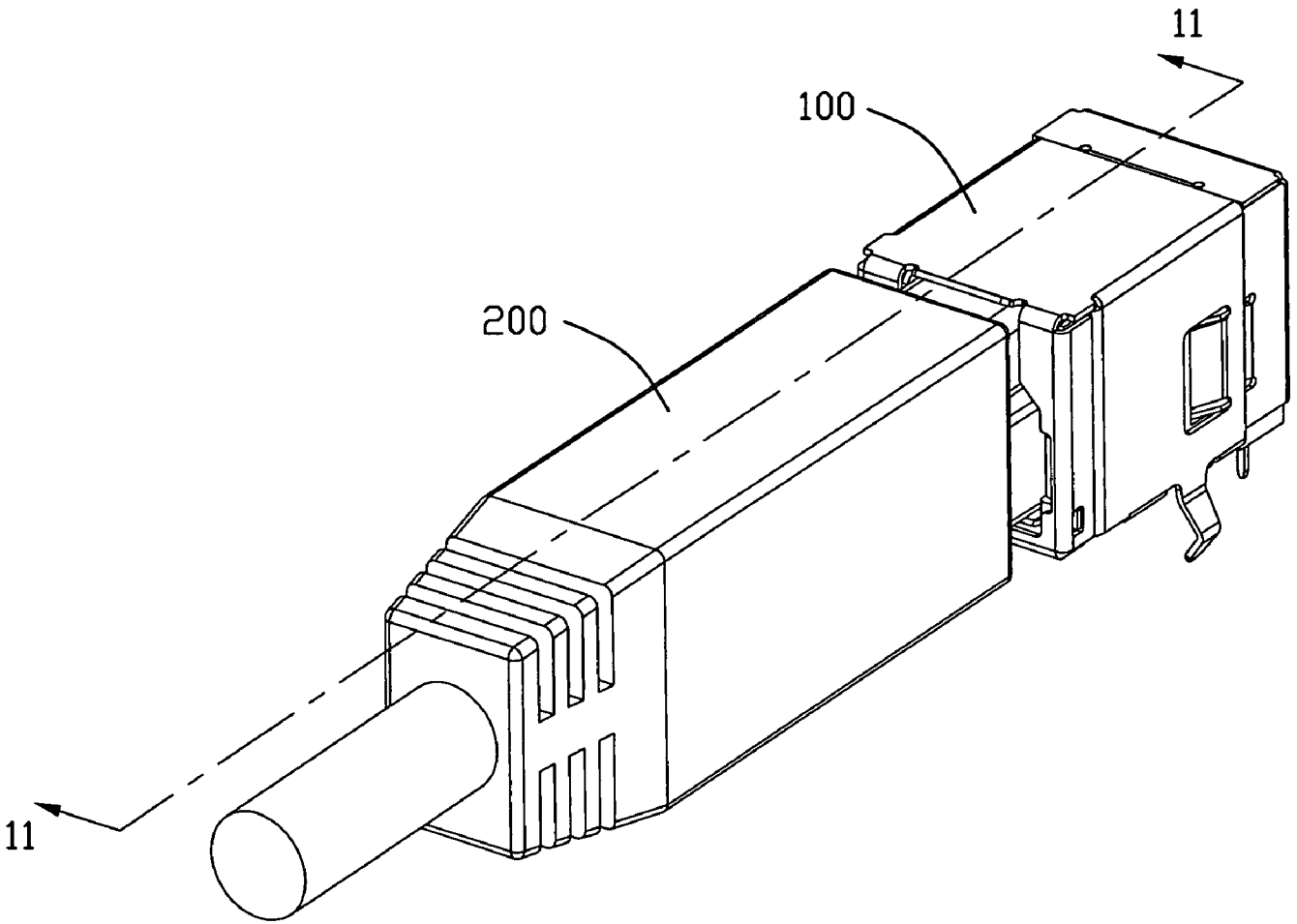
FIG. 10 is a perspective view of the electrical plug and receptacle, showing a state that the electrical plug is fully inserted into the electrical receptacle.

Referring to FIG. 10, an electrical connector of the preferred embodiment includes an electrical receptacle 100 and an electrical plug 200 for mating with the electrical receptacle 100. The electrical receptacle 100 is mounted on a Printed Circuit Board (PCB) and includes an insulative housing 1, a plurality of first and second contacts 2, 3 retained in the insulative housing 1, and a metal shield 4 enclosing the insulative housing 1 for EMI protection.

Figure 4:
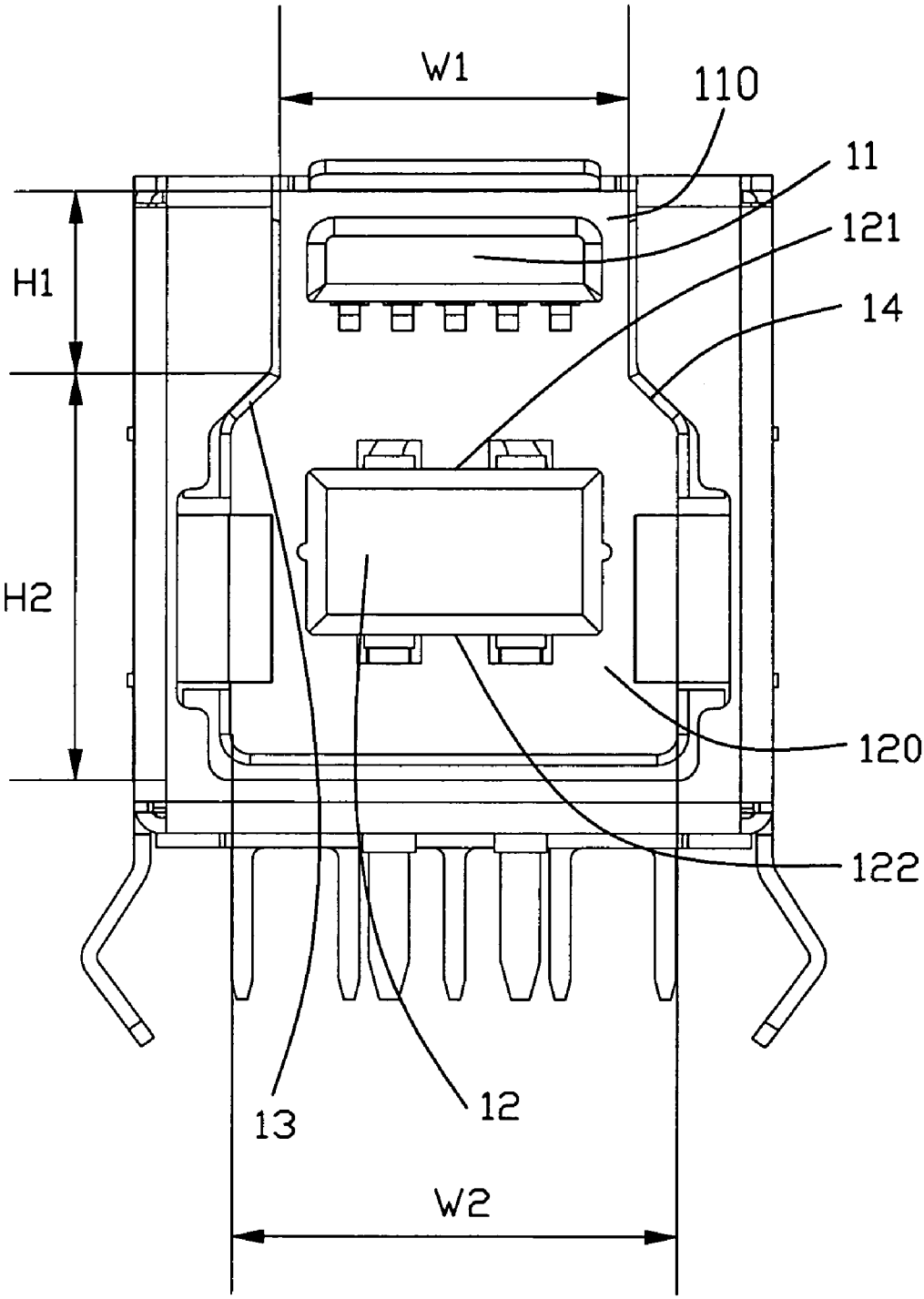
FIG. 4 is a front view of the electrical receptacle shown in FIG. 1.
Figure 15:
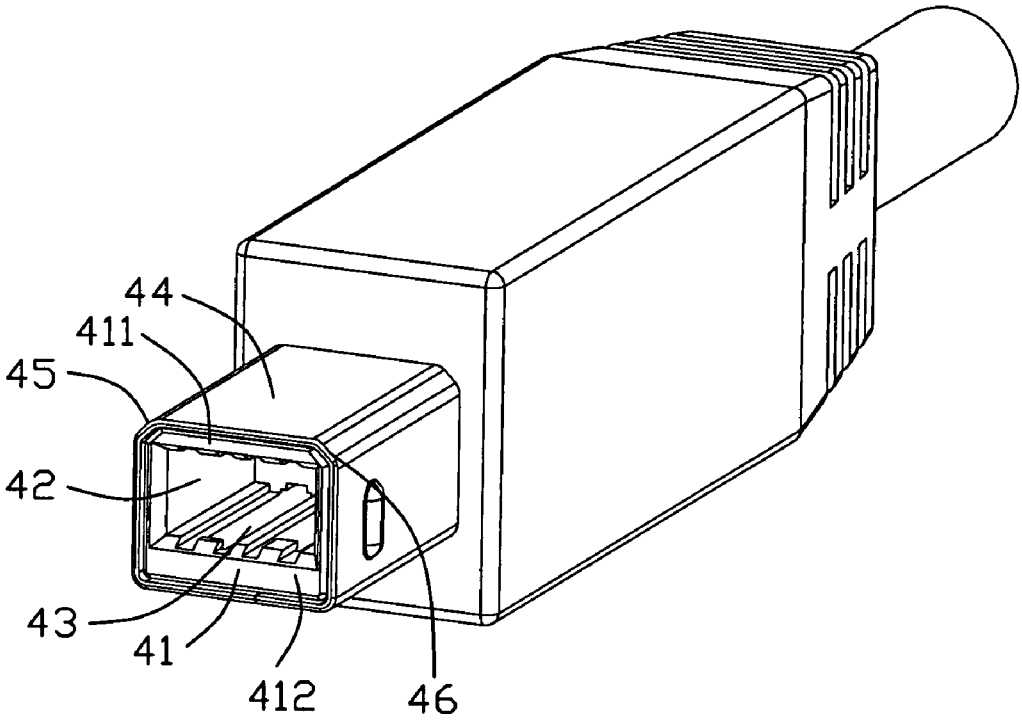
FIG. 15 (PRIOR ART)
FIG. 15 is a perspective view of a standard B-type USB 2.0 plug.

Referring to FIGS. 1-4, the insulative housing 1 is formed by plastic injection molding to have a base portion 10, a pair of first and second tongue portions 11, 12 extending forwardly from the base portion 10. The insulative housing 1 defines a first receiving cavity 110 with the first tongue portion 11 extending thereinto, and a second receiving cavity 120 with the second tongue portion 12 extending thereinto. The first and the second receiving cavities 110, 120 communicate with each other wherein the second receiving cavity 120 is much larger than the first receiving cavity 110. In detail, as shown in FIG. 4, the width W2 of the second receiving cavity 120 is larger than the width W1 of the first receiving cavity 110. The height H2 of the second receiving cavity is also larger than the height H1 of the first receiving cavity 110. The first receiving cavity 110 is substantially rectangular shaped. The insulative housing 1 has a pair of chamfered portions 13, 14 on its upper left corner and upper right corner, respectively. The chamfered portions 13, 14 act as keys for regulating the insertion orientation of the electrical plug 200 or the standard B-type USB 2.0 plug as shown in FIG. 15. In the preferred embodiment of the present invention, the first and the second tongue portions 11, 12 are stacked in a vertical direction. The first tongue portion 11 is an upper one and the second tongue portion 12 is a lower one. The first tongue portion 11 includes a mounting surface 111 which defines a plurality of grooves 112 for receiving the first contacts 2. The second tongue portion 12 is much thicker than the first tongue portion 11 along the vertical direction as shown in FIG. 4. The second tongue portion 12 includes opposite first and second surfaces 121, 122 on upper and lower sides thereof. The first and the second surfaces 121, 122 define a pair of passageways 123, 124, respectively, for receiving the second contacts 3. The mounting surface 111 is a lower surface of the first tongue portion 11. The mounting surface 111 is much closer to the first surface 121 than to the second surface 122. That is to say, the mounting surface 111 directly faces the first surface 121.

Figure 1:
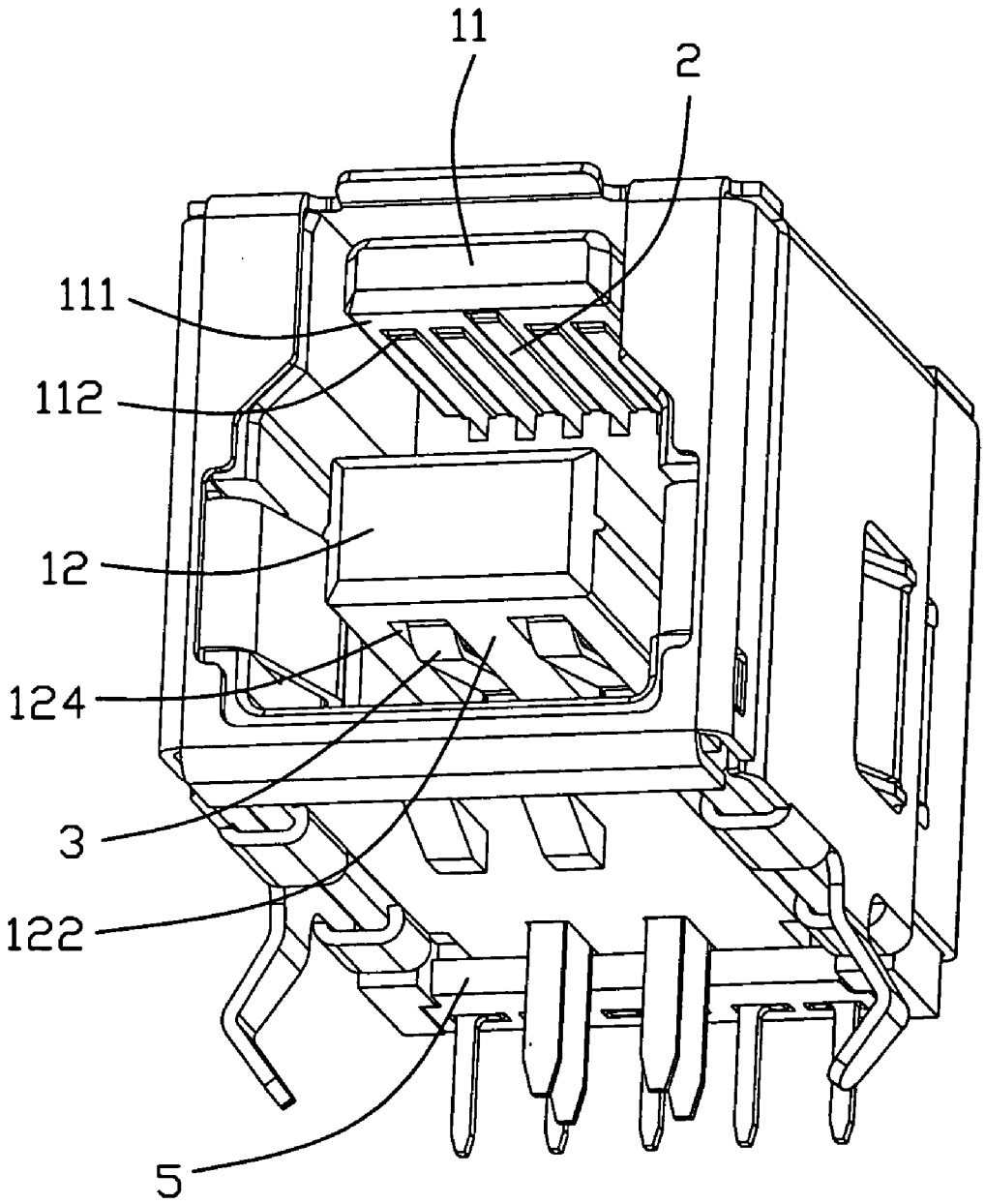
FIG. 1 is a perspective view of an electrical receptacle according to a preferred embodiment of the present invention.
Figure 2:
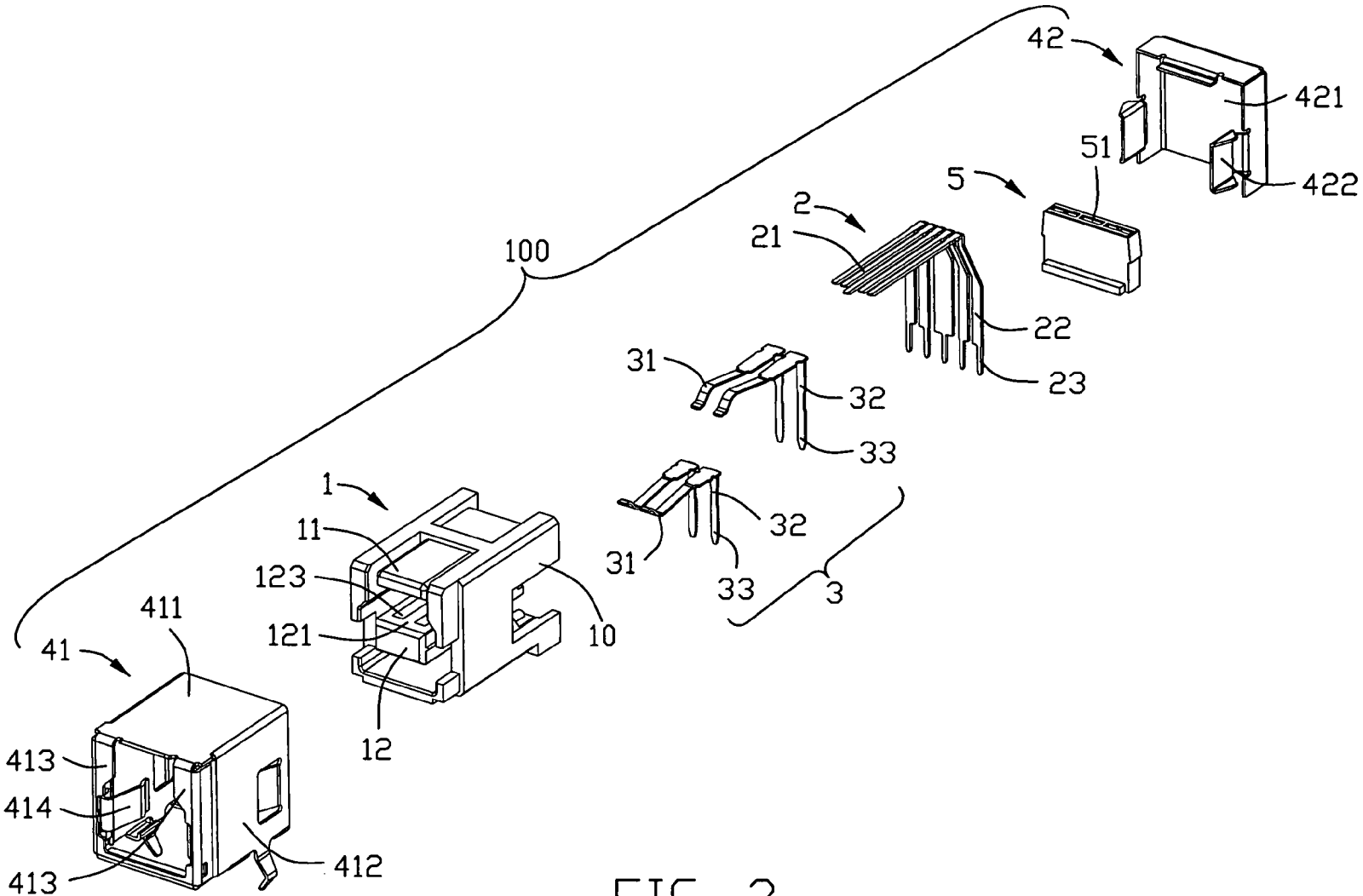
FIG. 2 is an exploded perspective view of the electrical receptacle.
Figure 3:
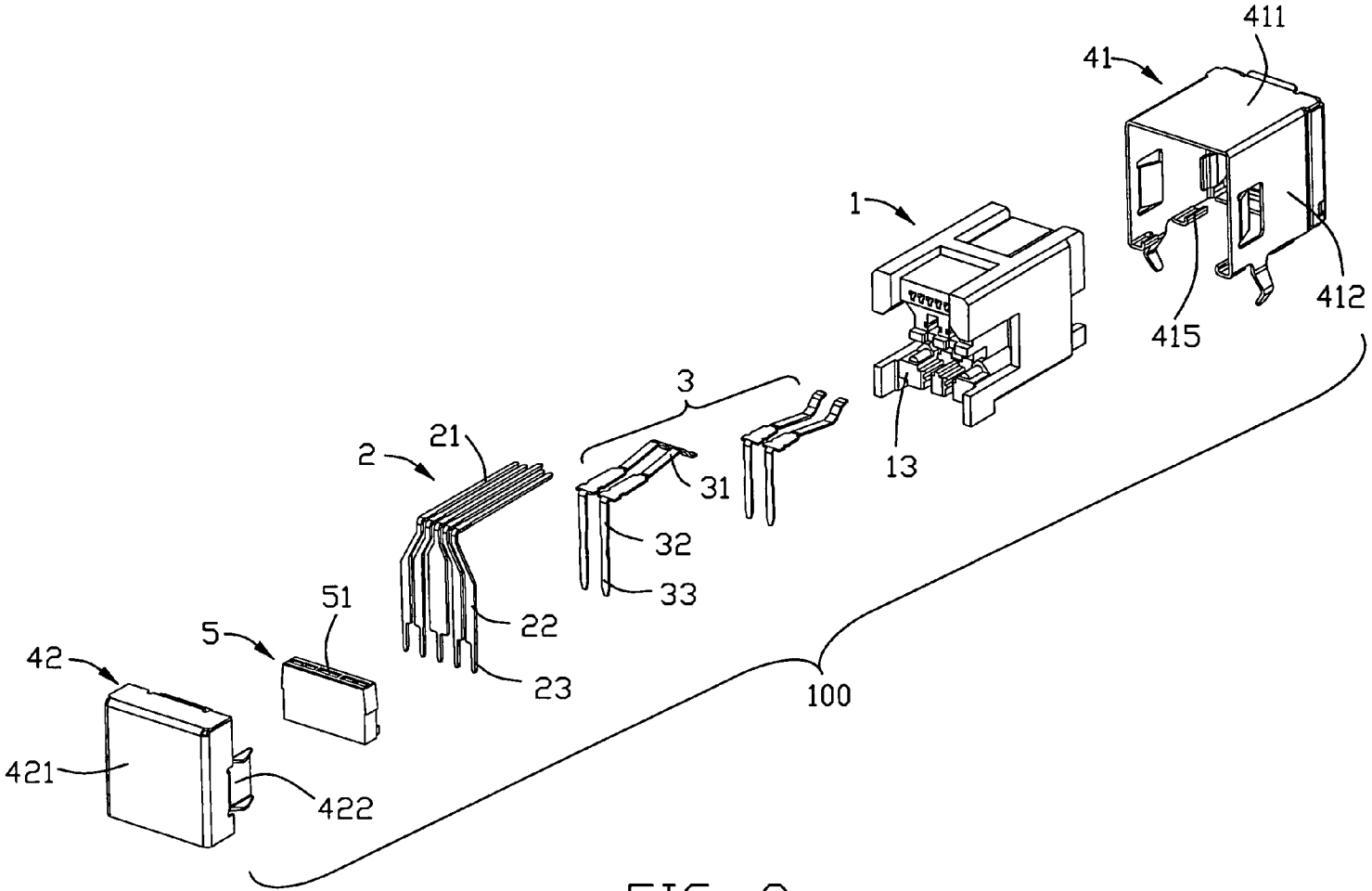
FIG. 3 is another exploded perspective view of the electrical receptacle, but taken from another aspect.

The first contacts 2 of the preferred embodiment are non-elastic. Each first contact 2 comprises a plate-shaped contact portion 21, a bending portion 22 perpendicular to the contact portion 21 and a tail portion 23 on a distal end of the bending portion 22. The contact portions 21 are attached to the grooves 111 of the first tongue portion 11 so that they can be exposed to the first receiving cavity 110 for mating with the electrical plug 200. As best shown in FIG. 1, the first contacts 2 of the preferred embodiment includes a middle grounding contact and two pairs of first and second signal contacts respectively disposed on lateral sides of the grounding contact. The grounding contact attached on the mounting surface 111 of the first tongue portion 11 is longer than that of the first or the second signal contact so that the front end of the grounding contact is much closer to a free end of the first tongue portion 11. With insertion of the electrical plug 400, the electrical plug 400 contacts the grounding contact first and then contacts the first and second signal contacts for better grounding protection.

The second contacts 3 of the preferred embodiment are elastic. Each second contact 3 comprises a convex shape elastic contact section 31, a bending section 32 perpendicular to the contact section 31 and a tail section 33 on a distal end of the bending section 32. The contact sections 31 are located on the passageways 123, 124 of the second tongue portion 12 and extend beyond the first and the second surfaces 121, 122 to protrude into the second receiving cavity 120.

Figure 5:
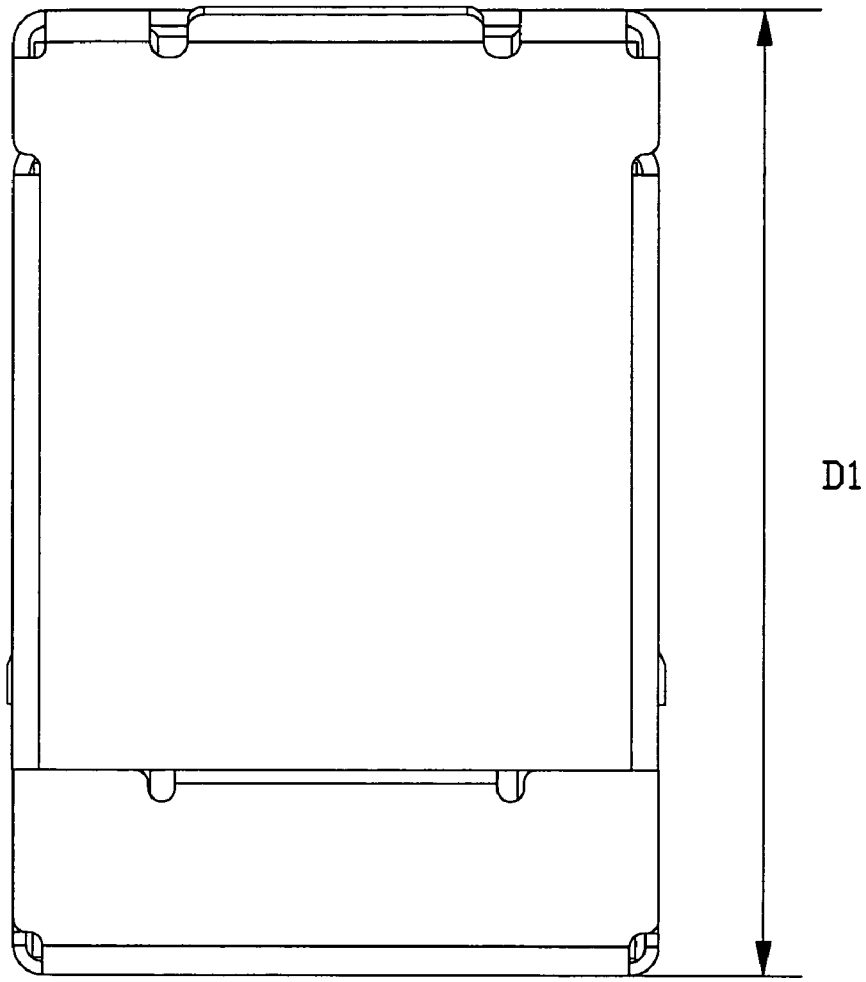
FIG. 5 is a top view of the electrical receptacle shown in FIG. 1.
Figure 6:
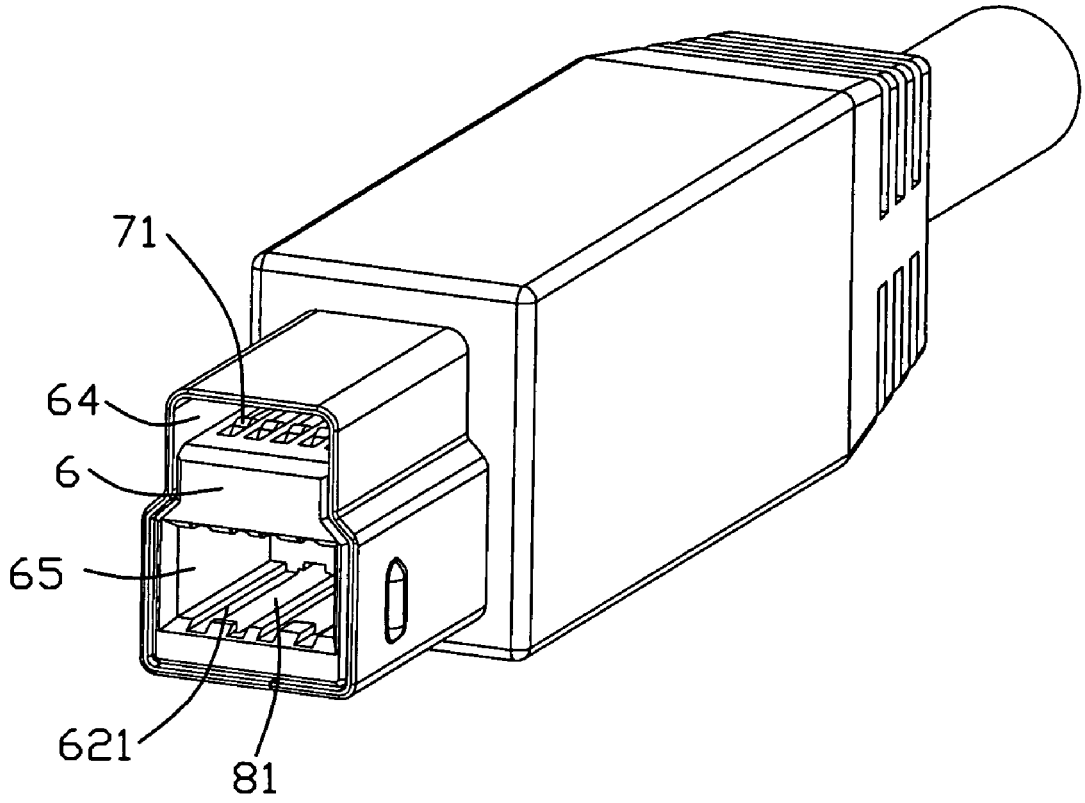
FIG. 6 is a perspective view of an electrical plug which can be inserted into the electrical receptacle.
Figure 7:
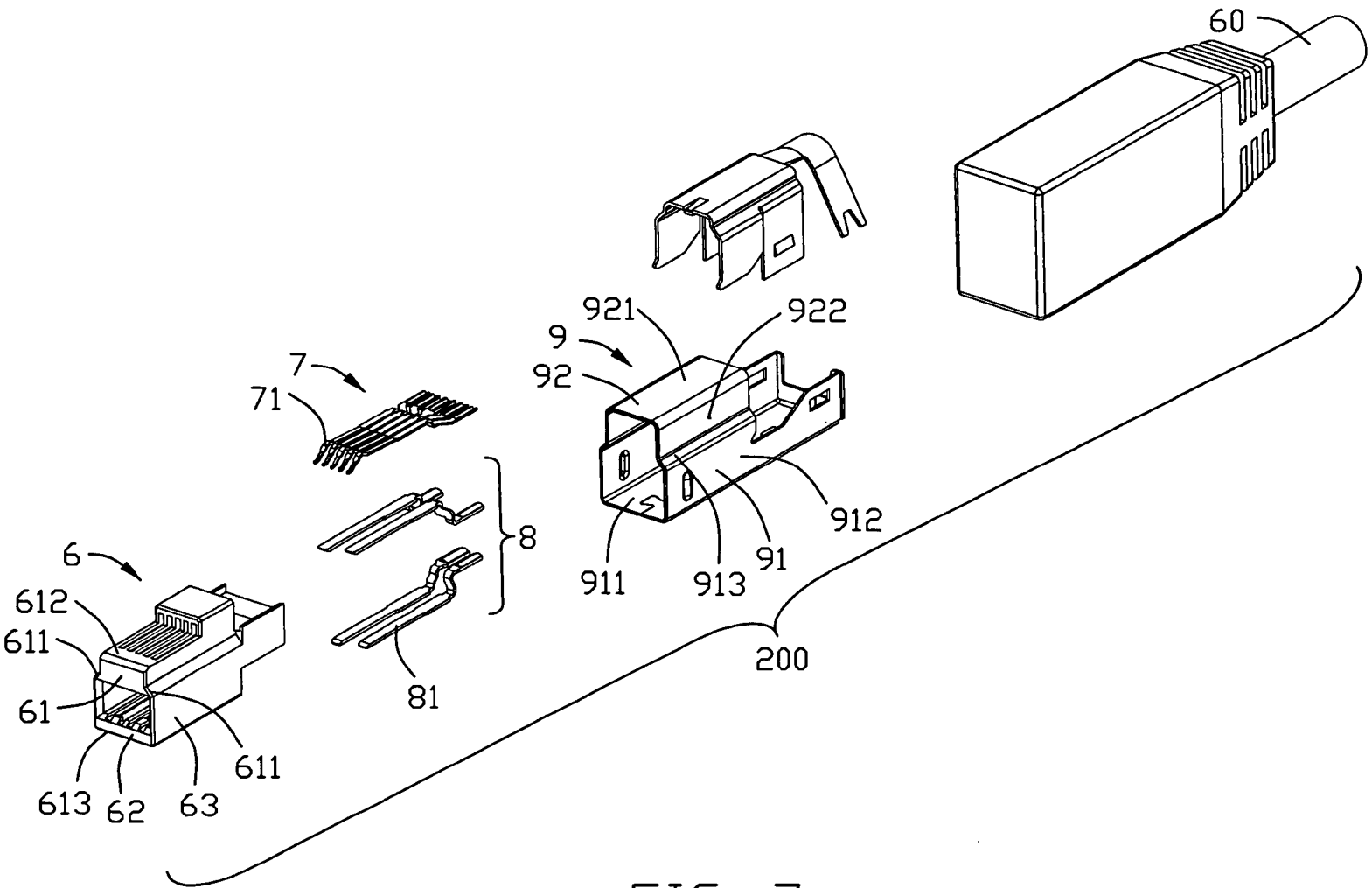
FIG. 7 is an exploded perspective view of the electrical plug.
Figure 8:
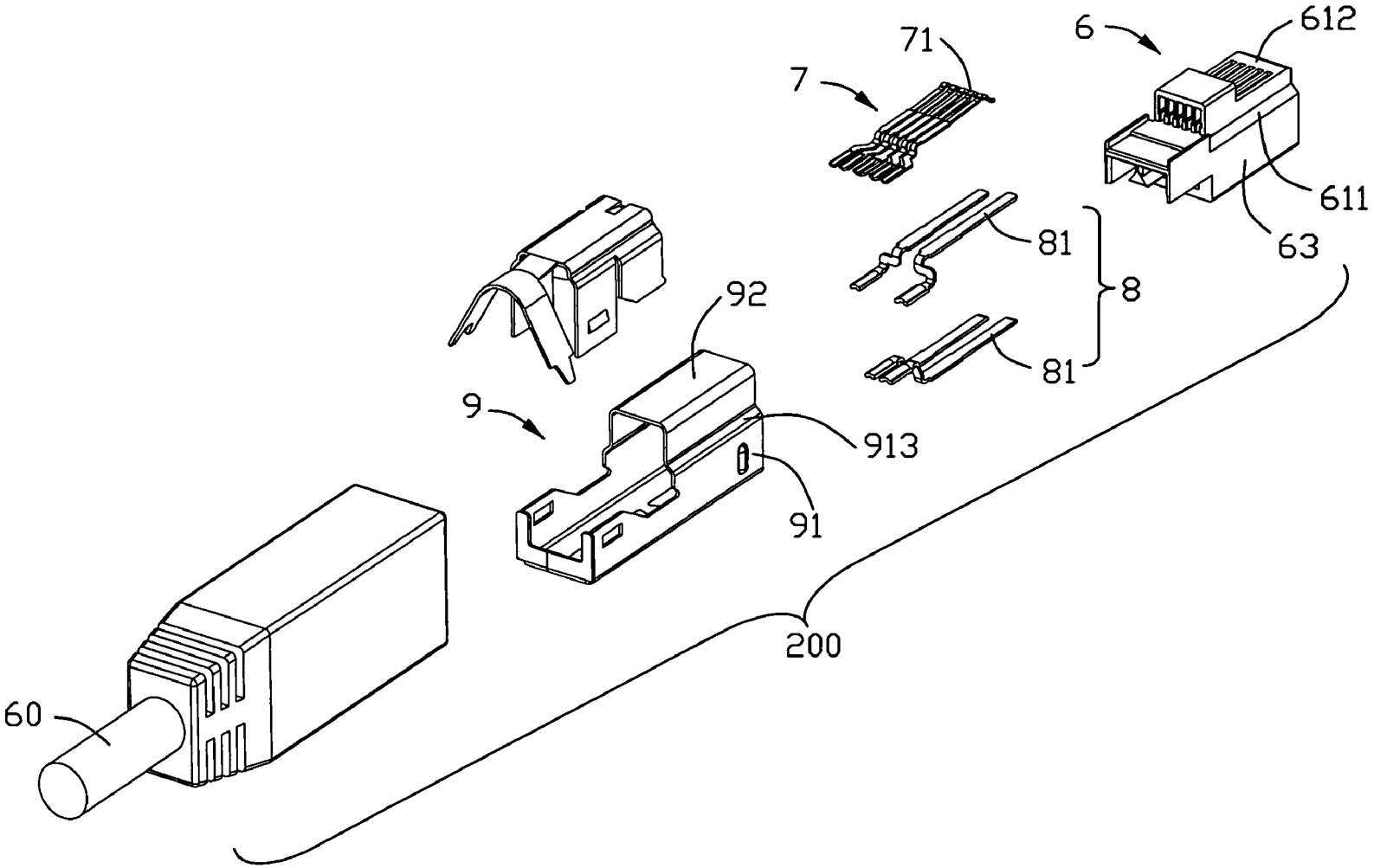
FIG. 8 is another exploded perspective view of the electrical plug, while taken from another aspect.
Figure 14:
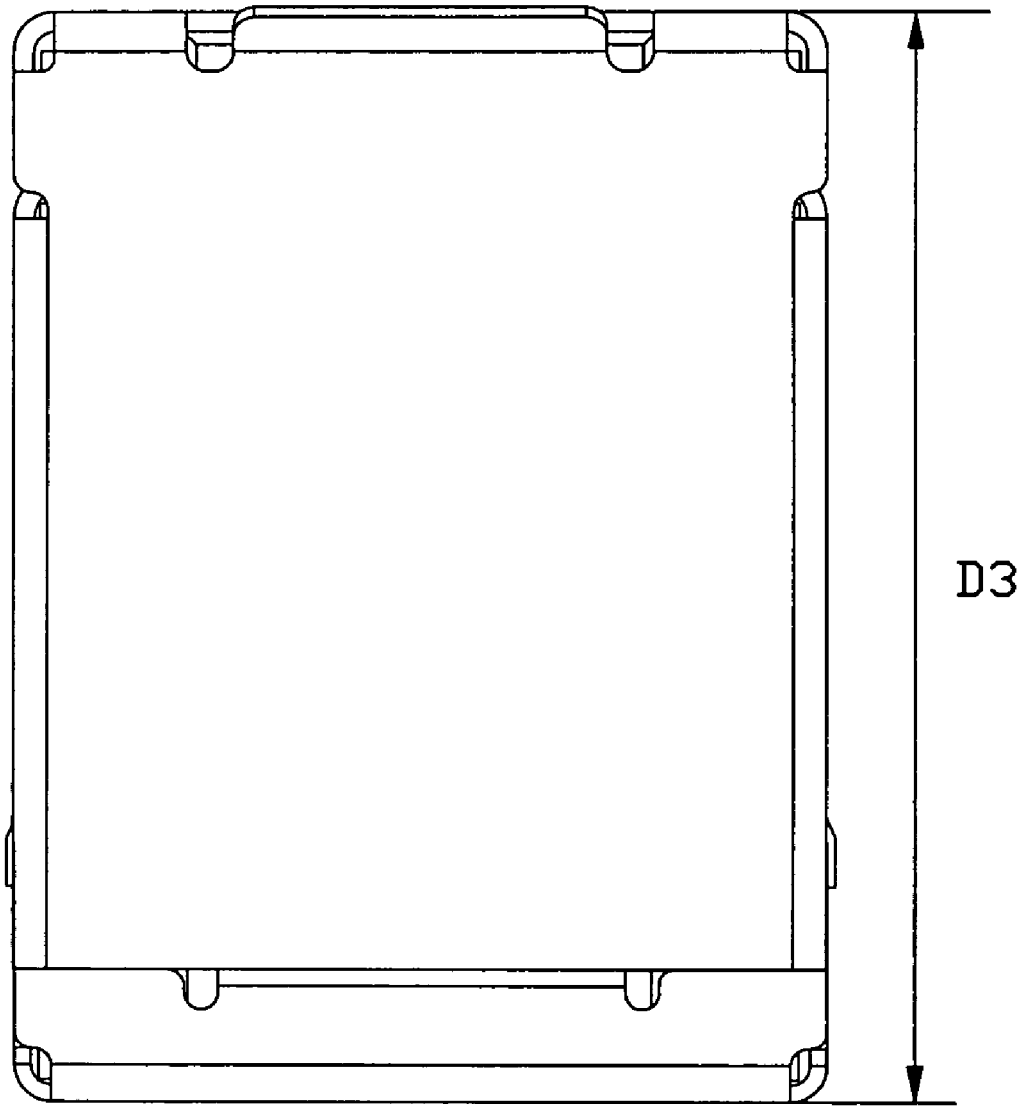
FIG. 14 (PRIOR ART)
FIG. 14 is a top view of the standard B-type USB 2.0 receptacle shown in FIG. 12.

In assembly, the bending portions 22 of the first contacts 21 are located on peripheral side of the bending sections 32 of the second contacts 3 so that the depth D1 of electrical receptacle 100 is much larger than the corresponding depth D3 of the existing B-type USB 2.0 receptacle 300 as shown in FIGS. 5 and 14.

The electrical receptacle 100 includes a lower port compatible to the existing standard B-type USB 2.0 plug shown in FIG. 15 and an additional upper port for transmitting high-speed signals in order to improve the transmission speed. The upper and the lower ports are simultaneously combined to receive the electrical plug 200. It is obvious that the whole height of the electrical receptacle 100 is much larger than that of the standard B-type USB 2.0 receptacle because of the existing of the upper port.

In order to organize all the tail portions 23 and tail sections 33 of the first and the second contacts 2, 3, the electrical receptacle 100 includes a spacer 5 attached to a rear face 13 of the insulative housing 1. The spacer 5 defines a plurality of through holes 51 for the tail portions 23 and tail sections 33 extending therethrough so that the tail portions 23 and tail section 33 can be easily mounted to the PCB.

The metal shield 4 includes a front metal shield 41 enclosing the insulative housing 1, a rear metal shield 42 attached to the front metal shield 41. The front metal shield 41 is stamped from a unitary one-piece metal sheet to have a top wall 411, a pair of side walls 412 and a pair of front walls 413 bending inwardly from front ends of the side walls 412. Each side wall 412 includes an engaging arm 414 extending into the second receiving cavity 120 for abutting against the electrical plug 200 or the standard B-type USB 2.0 plug 400. Each side wall 414 further includes a plurality of supporting portions 415 abutting against the spacer 5 so that the spacer 5 can be firmly fixed to the insulative housing 1. The rear metal shield 42 includes a rear wall 421 attached to the insulative housing 1 and a pair of arms 422 abutting against the side wall 412 of the front metal shield 41.

Figure 9:
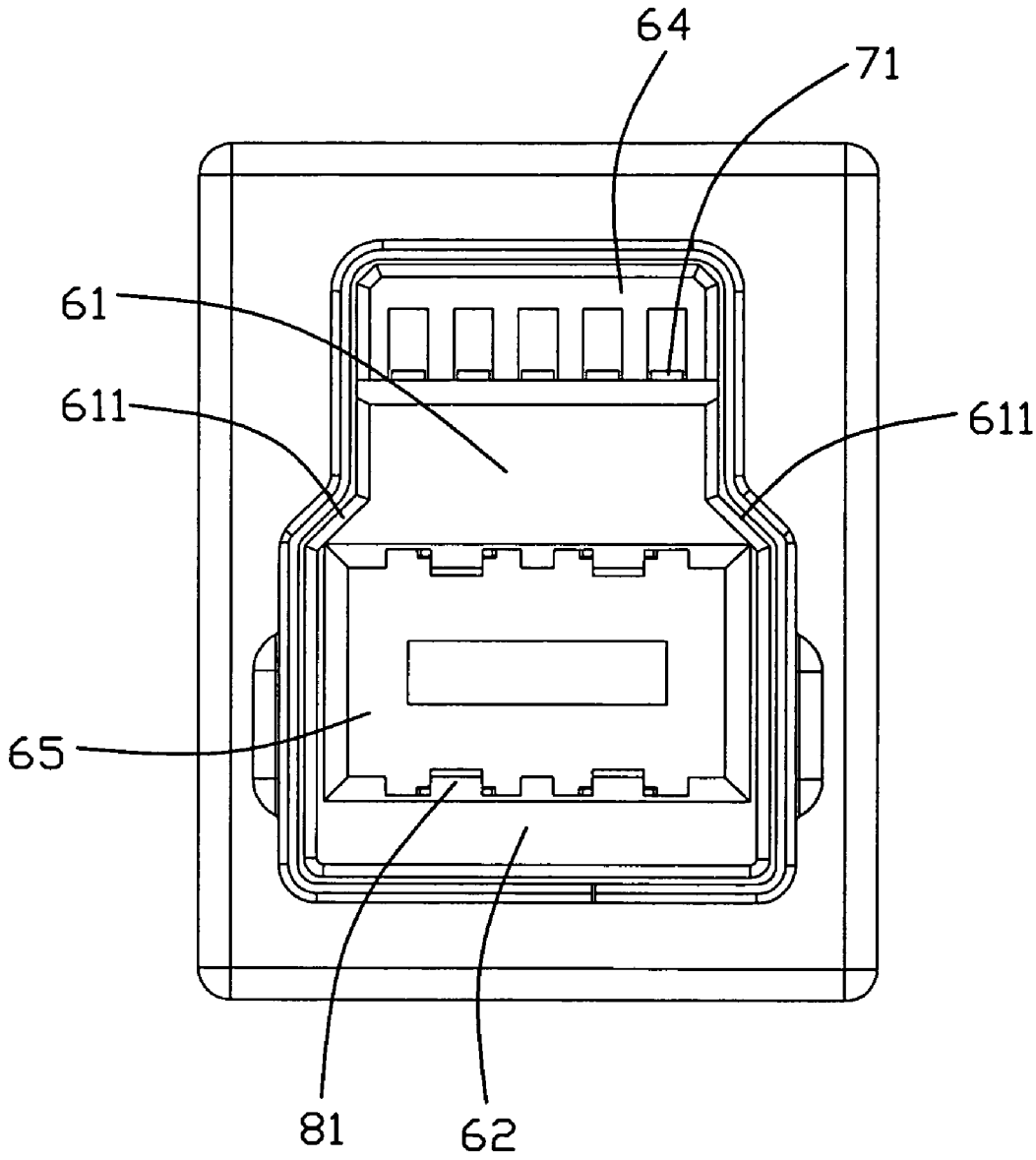
FIG. 9 is a front view of the electrical plug shown in FIG. 6.

The electrical plug 200 includes an insulator 6, a plurality first and second plug contacts 7, 8 retained in the insulator 6, a metal shell 9 enclosing the insulator 6 and a cable 60 electrically connecting with the first and the second plug contacts 7, 8. The insulator 6 is frame-shaped and includes an upper separate plate 61, a bottom portion 62 opposite to the separate plate 61 and a pair of side portions 63 connecting the separate plate 61 and the bottom portion 62. The metal shell 9 has a lower portion 91 and an upper portion 92 narrower than the lower portion 91. The upper portion 92 includes a top wall 921 and a pair of first side walls 922. The lower portion 91 includes a bottom wall 911 attached to the bottom portion 62 of the insulator 6, and a pair of second side walls 912 attached to the side portions 63 of the insulator 6. The separate plate 61 includes a pair of slant portions 611 on lateral sides thereof. The second side walls 912 comprise a pair of corresponding slant sections 913 attached to the slant portions 611 for mating with the chamfered portions 13, 14 of the electrical receptacle 100. A first opening 64 is enclosed by the top wall 921, a pair of first side walls 922 and the separate plate 61. The insulator 6 defines a second opening 65 enclosed by the separate plate 61, the pair of side portions 63 and the bottom portion 62. That is to say the first and the second openings 64, 65 are separated by the separate plate 61 which includes a first side 612 exposing to the first opening 64 and a second side 613 exposing to the second opening 65. The second opening 65 is much bigger than the first opening both in height and width as best shown in FIG. 9. The first plug contacts 7 are elastic and include elastic engaging sections 71 extending into the first opening 64 for abutting against the contact portions 21 of first contacts 2. The second plug contacts 8 are attached to the second side 613 of the separate plate 61 and an inner side 621 of the bottom portion 62, respectively. The second plug contacts 8 are non-elastic and include plate-shaped mating sections 81 exposed to the second opening 65 for abutting against the elastic contact sections 31 of the second contacts 3.

Figure 11:
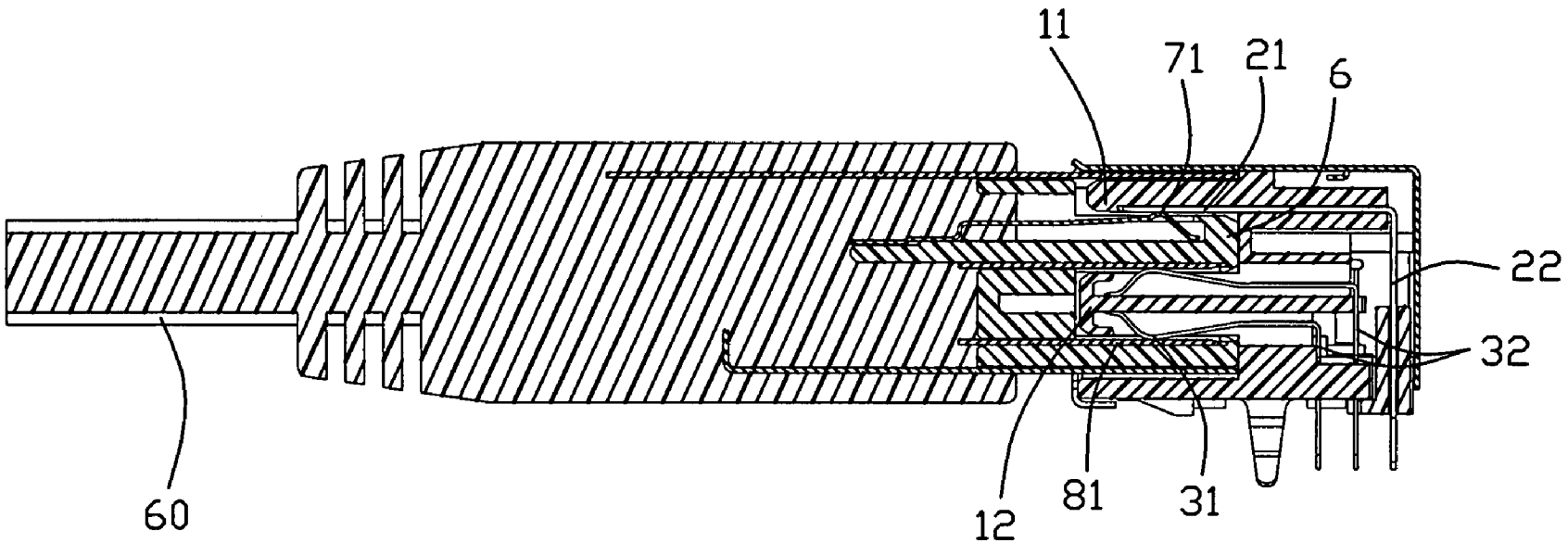
FIG. 11 is a cross-sectional view of the electrical plug and receptacle taken along line 11-11 of FIG. 10, showing contacts mating with each other.
Figure 12:
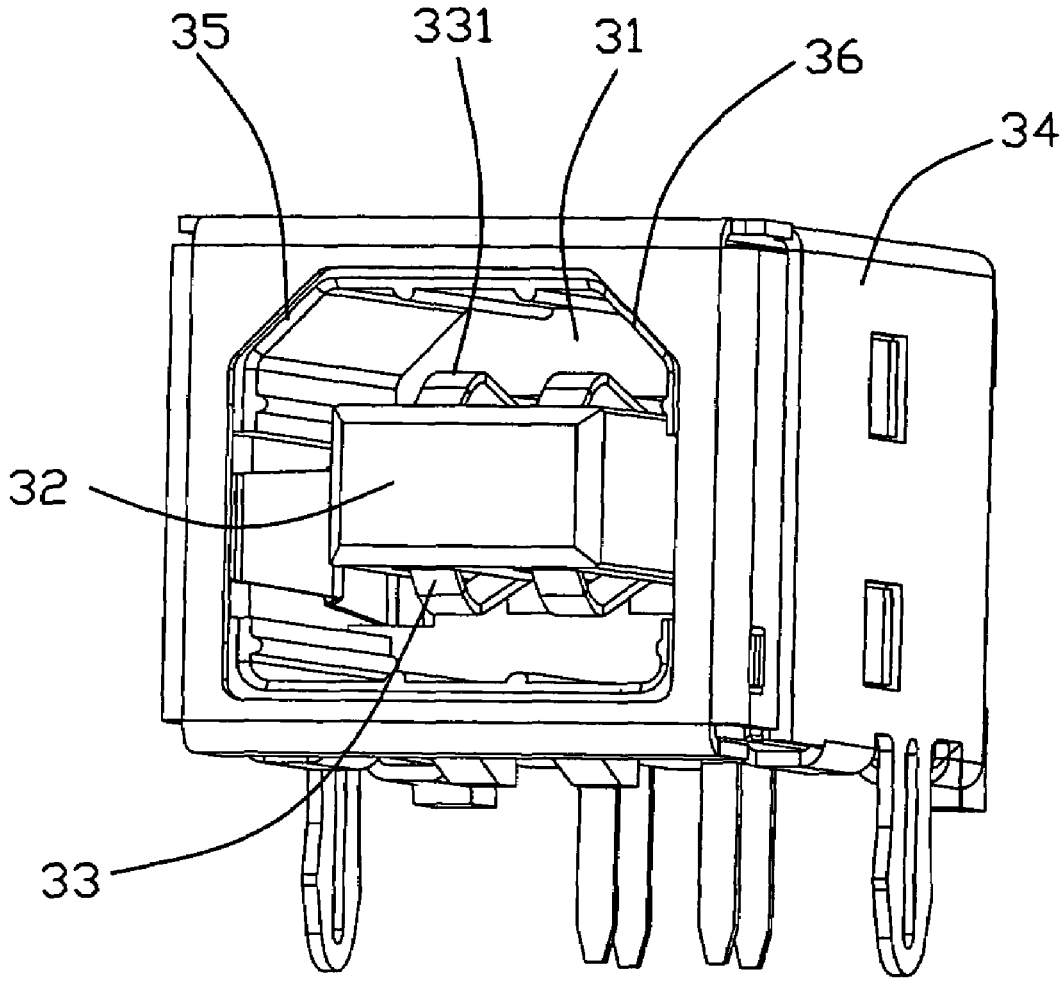
FIG. 12 (PRIOR ART)
FIG. 12 is a perspective schematic view of a standard B-type USB 2.0 receptacle.
Figure 13:
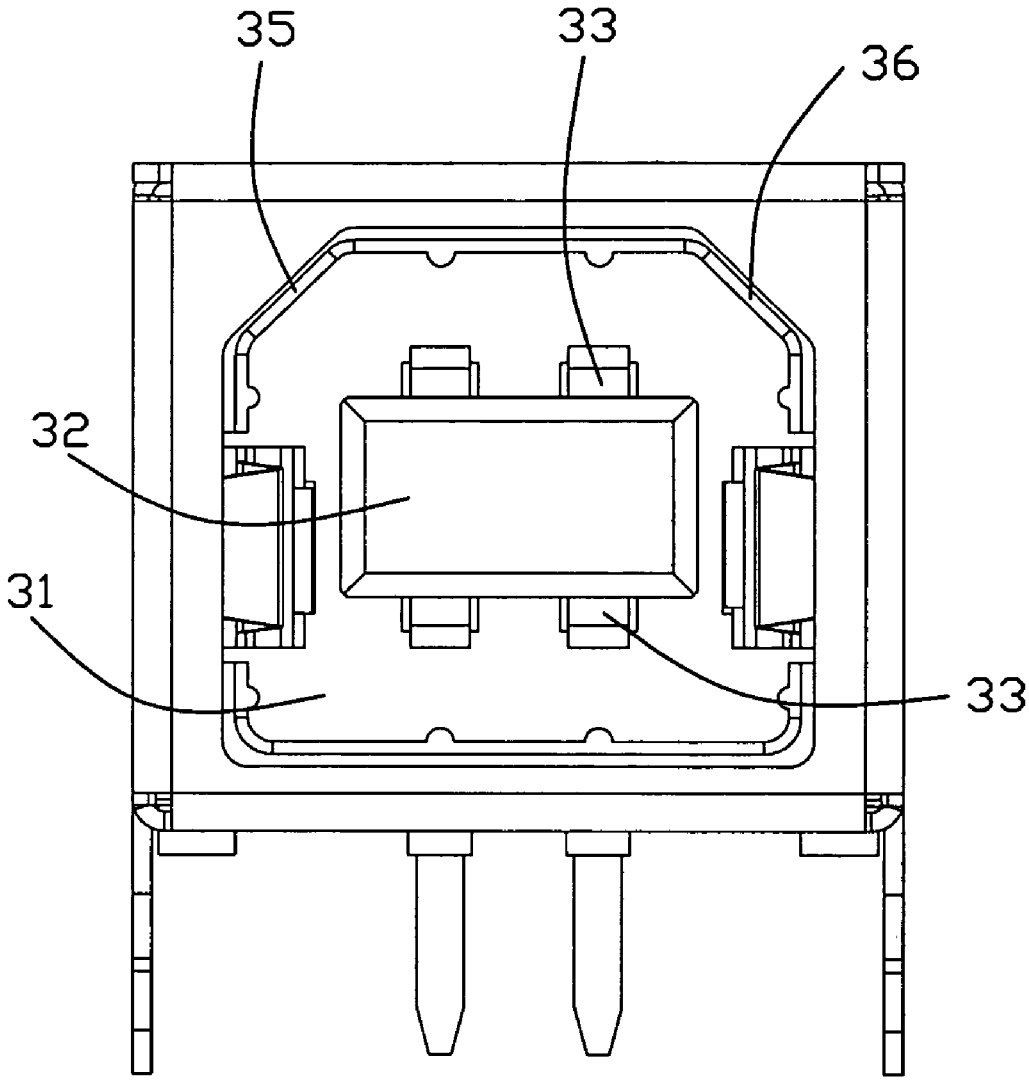
FIG. 13 (PRIOR ART)
FIG. 13 is a front view of the standard B-type USB 2.0 receptacle shown in FIG. 12.

In FIGS. 10 and 11, a mating status of the electrical plug 200 fully insertion into the electrical receptacle 100 is shown. After the electrical plug 200 is fully inserted into the electrical receptacle 100, all plug contacts 7, 8 physically contact corresponding contacts 2, 3 of the electrical receptacle 100 as clearly shown in FIG. 10. Since the electrical receptacle 100 is compatible to the existing standard B-type USB 2.0 plug 400, with insertion of the standard B-type USB 2.0 plug 400, only the second contacts 3 of the electrical receptacle 100 abut against the contacts 43 of the B-type USB 2.0 plug 400.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical receptacle, comprising:

a first receiving cavity with a first tongue portion extending thereinto;

a second receiving cavity communicating with the first receiving cavity with a second tongue portion extending thereinto, the first receiving cavity being essentially narrower than the second receiving cavity, the first and the second tongue portions being parallel to each other;

a plurality of first contacts disposed on a mounting surface of the first tongue portion;

a plurality of second contacts disposed on opposite first and second surfaces of the second tongue portion and protruding into the second receiving cavity; and an insulative housing with the first and the second receiving cavities defined therein, the insulative housing comprising at least one chamfered portion on top of the second receiving cavity;

wherein the first contacts are non-elastic and exposed to the first receiving cavity, the second contacts being elastic and comprising convex portions extending into the second receiving cavity.

2. The electrical receptacle as claimed in claim 1, wherein the mounting surface is much closer to the first surface of the second tongue portion than to the second surface of the second tongue portion, the mounting surface directly facing the first surface of the second tongue portion, the first contacts being plate-shaped and disposed on the mounting face.

3. The electrical receptacle as claimed in claim 1, wherein the second contacts include two contacts disposed on the first surface of the second tongue portion, and two contacts disposed on the second surface of the second tongue portion.

4. The electrical receptacle as claimed in claim 1, wherein the second tongue portion is much thicker than the first tongue portion.

5. The electrical receptacle as claimed in claim 1, wherein the first tongue portion is located upper the second tongue portion, the mounting surface being a lower surface of the first tongue portion, the first and the second surfaces being opposite upper and lower surfaces of the second-tongue portion, respectively.

6. The electrical receptacle as claimed in claim 1, wherein the electrical receptacle is much higher and deeper than that of a standard B-type USB 2.0 receptacle.

7. The electrical receptacle as claimed in claim 1, wherein the first contacts comprise a middle grounding contact and two pairs of signal contacts disposed on lateral sides of the grounding contact.

8. The electrical receptacle as claimed in claim 1, wherein the second contacts are for USB 2.0 protocol, the second receiving cavity being of corresponding shape to accommodate a standard B-type USB 2.0 plug.

9. The electrical receptacle as claimed in claim 8, wherein the second receiving cavity is much higher than the first receiving cavity, the first and the second receiving cavities being combined to receive another electrical plug.

10. An electrical plug, comprising:

a first opening with a plurality of first plug contacts protruding thereinto;

a second opening with a plurality of second plug contacts exposed thereto;

the first and the second openings being separated by a separate plate in condition that the first and the second plug contacts are disposed on opposite first and second sides of the separate plate, respectively, a metal shield shielding the first and the second openings; and a frame insulator with the second opening defined therein, the separate plate acting as one peripheral wall of the frame insulator, the metal shield shielding the frame insulator;

wherein the second opening is much larger than the first opening;

wherein the first plug contacts are elastic and the second plug contacts are non-elastic;

wherein the frame insulator comprises another peripheral wall opposite to the separate plate with another plurality of second plug contacts disposed thereon.

11. An electrical connector assembly comprising:

an insulative housing defining a receiving cavity with first and second mating tongues extending therein respectively at different levels;

a plurality of first contacts disposed on the first mating tongue;

a plurality of second contacts disposed on the second mating tongue;

said receiving cavity defining a small width around the first mating tongue and a large width around the second mating tongue so as to assure not only a complementary two-port plug is allowed to be completely mated with both the first and the second mating tongues and occupies the receiving cavity fully, but also a one port plug is allowed to be solely mated with the second mating tongue and occupies only a portion of said receiving cavity with said large width thereabouts;

wherein said complementary plug includes a dielectric housing enclosed by a metal shell under a condition that a second mating cavity, for receiving said first mating tongue, is formed by both said metal shell and a dielectric housing, and a first mating cavity, for receiving said second mating tongue, is formed by said dielectric housing only;

wherein the first mating cavity and the second mating cavity are isolated from each other via said dielectric housing.

12. The assembly as claimed in claim 11, wherein said first mating tongue and said second mating tongue have a similar width while different thicknesses with each other.

* * * * *